US005336861A

United States Patent [19]

Cummins et al.

[11] Patent Number: 5,336,861

[45] Date of Patent: Aug. 9, 1994

[54] SWITCH WITH REMOVABLE BUTTON FRAME

[75] Inventors: Brad L. Cummins; William A. Pick; Ronald R. Sorn; Karl F. Stocker, all of Stephenson, Ill.

[73] Assignee: Honeywell Inc., Minneapolis, Minn.

[21] Appl. No.: 54,383

[22] Filed: Apr. 28, 1993

[51] Int. Cl.[5] ..... H01H 3/00

[52] U.S. Cl. ..... 200/339; 200/345; 200/553; 200/558

[58] Field of Search ..... 200/339, 345, 553, 554, 200/555, 556, 557, 558, 559, 560, 561, 562, 563, 309

[56] References Cited

U.S. PATENT DOCUMENTS 3,681,556 8/1972 Osika ..... 200/339
4,045,650 9/1977 Nestor ..... 200/556
5,008,503 4/1991 Stuhlmacher ..... 200/339
5,053,591 10/1991 Theurer ..... 200/339

*Primary Examiner*—Henry J. Recla
*Assistant Examiner*—David J. Walczak
*Attorney, Agent, or Firm*—William D. Lanyi

[57] ABSTRACT

A switch is provided with a button frame which has two openings and two associated cam surfaces. A pivot pin can be assembled with a support structure and the button frame can be assembled onto the pivot pin by distorting the button frame. One end of the pivot pin is first inserted into a first opening of the button frame. Then the button frame is pushed downward to cause a second end of the pivot pin to move along a cam surface associated with a second opening. Further downward force causes the second end of the pivot pin to snap into the second opening.

20 Claims, 7 Drawing Sheets

SECTION III – III

SWITCH WITH REMOVABLE BUTTON FRAME

BACKGROUND OF THE INVENTION

1. Field of the Invention

The present invention relates generally to switches, such as rocker switches and, more particularly, to switches which provide an attachment between a button frame and an actuator lever which facilitates the assembly and removal of the button frame from the switch body.

2. Description of the Prior Art

Switches that incorporate rocker arms are well known to those skilled in the art and will be described in greater detail below. Switches that are known to the skilled artisan require the assembly of numerous individual components in a prescribed order. The complexity of the assembly process severely inhibits the partial disassembly by a subsequent user of the switch which is sometimes necessary to properly attach the switch to other apparatus. The difficulty of disassembly and reassembly of the button frame to the body of the switch is severely disadvantageous because it restricts the type of mounting arrangements in which the switch can be used. In addition, the inability of assembling the switch components prior to attaching the button frame severely limits the type of sealing arrangements that can be used in the switch.

SUMMARY OF THE INVENTION

A switch made in accordance with the present invention comprises a support structure in which a pivot pin is attached. The pivot pin is arranged so that it extends perpendicularly through an actuator pin. Since the pivot pin is attached to the support structure, the actuator pin is rotatable about a central axis of the pivot pin and can be used to transfer rotational movement from a button frame to switching components within the body of the switch. The button frame of the present invention comprises first and second openings which are shaped to receive first and second ends of the pivot pin. The button frame also has a third opening which is shaped to receive a first end of the actuator pin. The button frame also comprises first and second cam surfaces which are formed in the button frame and extend from the first and second openings to edges of the button frame. The cam surfaces are spaced apart by a preselected distance in order to permit the second end of the pivot pin to slide along the second cam surface and into the second opening when the first end of the pivot pin is disposed within the first opening of the button frame. A button is attached to the button frame and is retained in position when a plurality of protrusions formed on an outer surface of the button frame are received in a plurality of openings formed in the button. This permits the button to be snapped into position on the button frame.

A first expanded portion of the button frame is provided proximate the first cam surface and a second expanded portion of the button frame is provided proximate the second cam surface. These first and second expanded portions improve the strength of the button frame proximate an end of the cam surface where the structure of the button frame would otherwise have been severely reduced in thickness. The third opening of the button frame is provided with a tapered portion for the purpose of enlarging one end of the third opening to permit entry of the first end of the actuator pin into the third opening when the first end of the pivot pin is disposed within the first opening of the button frame and the second end of the pivot pin is in contact with the second cam surface. The tapered portion of the third opening, in association with the second cam surface, allows the button frame to be assembled onto the first and second ends of the pivot pin after the pivot pin and actuator pin are attached to the support structure.

In one embodiment of the present invention, a first slot is formed in the button frame and shaped to receive a blade therein for momentarily distorting the button frame to increase the preselected distance between the first and second cam surfaces. This temporary distortion of the button frame allows the button frame to be removed from the first and second ends of the pivot pin after assembly. A case is attached to the support structure and an electrical switching mechanism is disposed within the case and connected to a second end of the actuator pin. Some embodiments of the present invention also comprise a mounting panel that is attached to the support structure with the support structure being attached to one surface of the mounting panel and extending through an opening formed through the mounting panel.

BRIEF DESCRIPTION OF THE DRAWINGS

The present invention will be more fully understood from a reading of the Description of the Preferred Embodiment in conjunction with the drawings, in which.

DESCRIPTION OF THE PREFERRED EMBODIMENT

Figure 1:
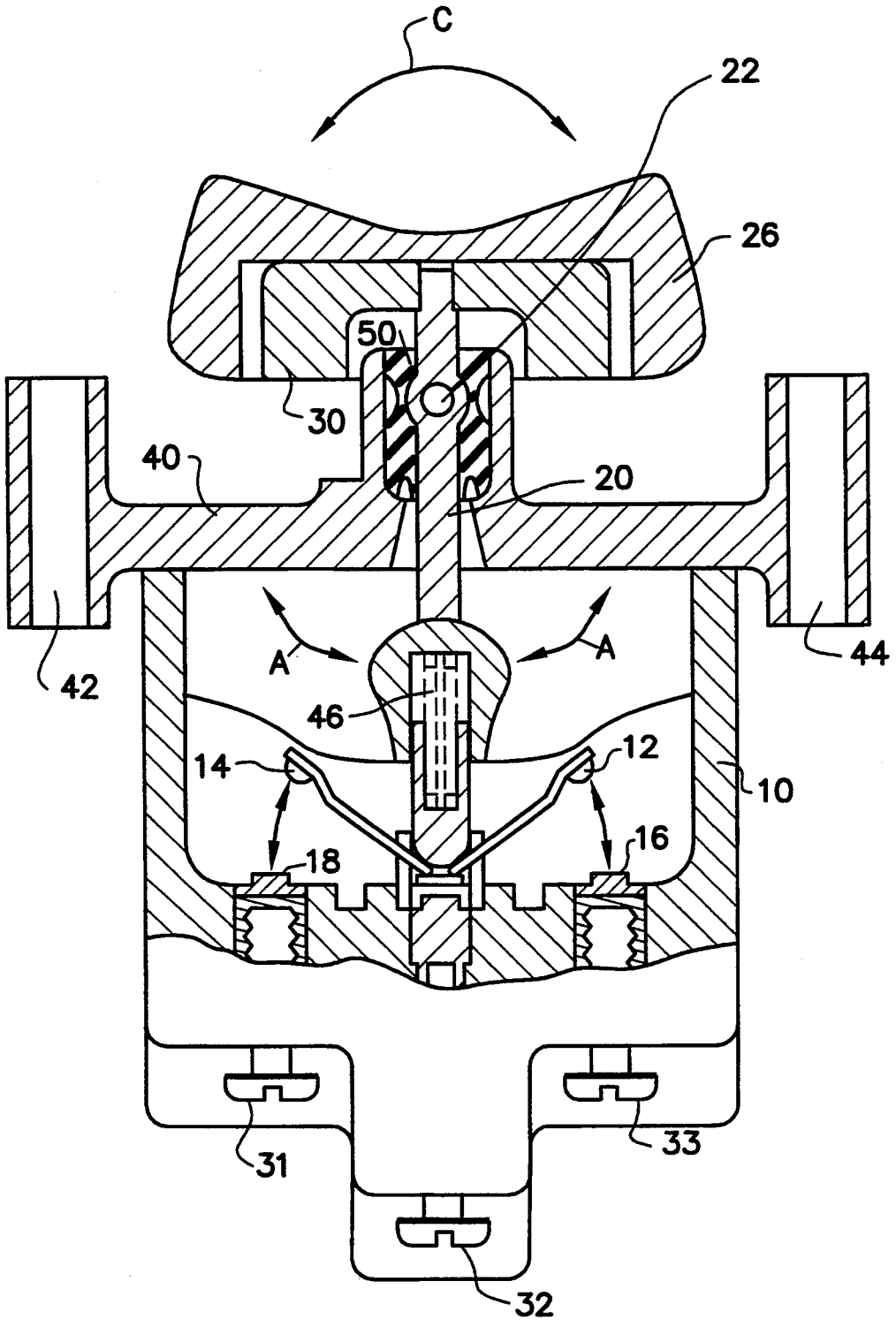
Fig. 1 (PRIOR ART)
FIGS. 1 illustrates a section view of a rocker switch known to those skilled in the art.

Throughout the Description of the Preferred Embodiment, like components will be identified by like reference numerals. In FIG. 1, a known rocker switch is illustrated in section view. A case 10 contains a switching mechanism that comprises moveable contacts 12 and 14 that can be selectively moved into electrical communication with associated stationary contacts, 16 and 18, respectively. The movement of the moving contacts relative to the stationary contacts is illustrated by the arrows between them. This rocking movement of the moveable contacts is accomplished as a result of the partial rotation of an actuator pin 20 about a center of rotation at a pivot pin 22 as illustrated by arrows A in FIG. 1. The partial rotation of the actuator pin 20 is accomplished by manually causing a button 26 to move a button frame 30 about the center of the pivot pin 22. With continued reference to FIG. 1, several screw connectors, 31, 32 and 33, are provided to permit the switch to be connected to external conductors. A support structure 40 provides support for the pivot pin 22 and is attached to the case 10. The support structure 40 is provided with mounting holes, 42 and 44, which permit the switch to be attached to an external component. As the button 26 is moved about the central axis of the pivot pin 22, as illustrated by arrow C, the actuator pin 20 moves in the directions represented by arrows A and, in cooperation with the action of a spring 46, causes the moveable contacts to alternately move into contact with their associated stationary contacts. A seal 50 is disposed within a generally cylindrical opening of the support structure 40 to prevent fluid to leak around the actuator pin 20 and into the internal portion of the case 10.

Figure 2:
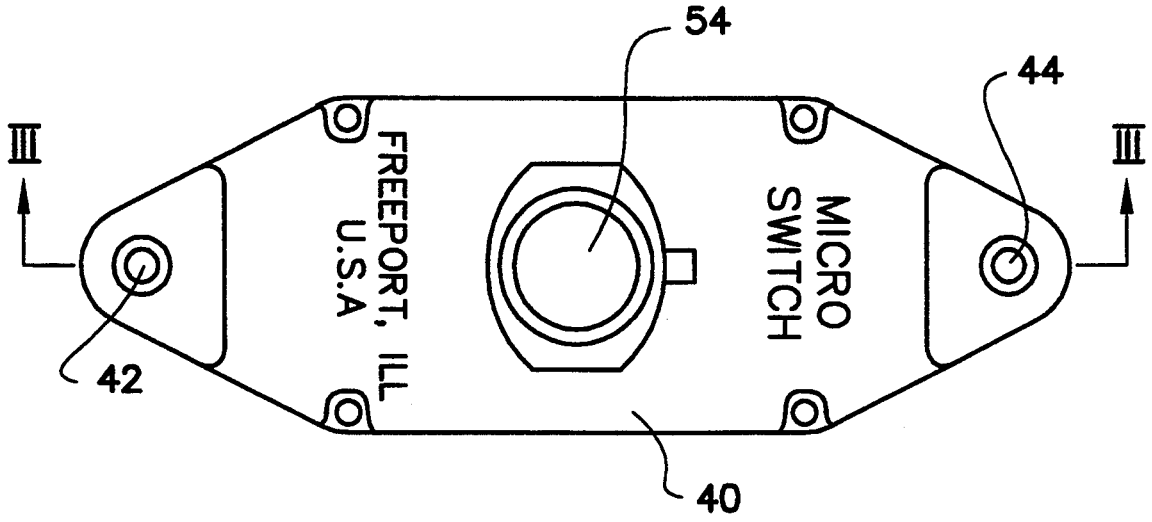
Fig. 2 (PRIOR ART)
FIGS. 2 and 3 illustrate a support structure made in accordance with the concepts known to those skilled in the art.
Figure 3:
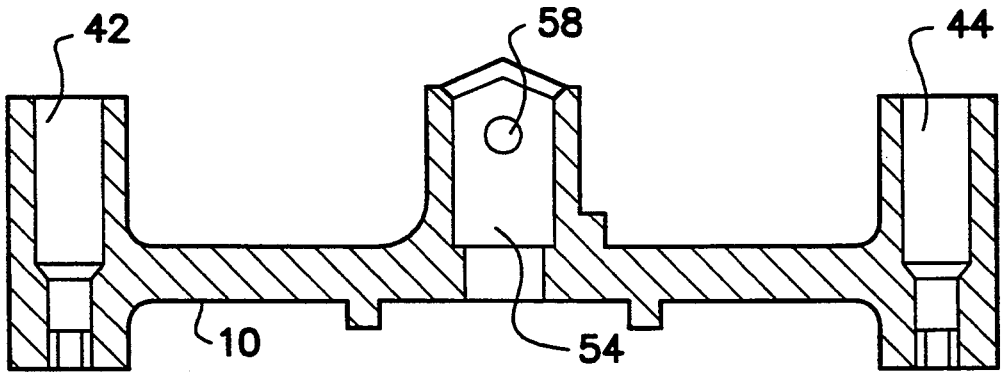
Fig. 3 (PRIOR ART)

FIG. 2 shows a top view of the support structure 40 and FIG. 3 is a sectional view of the support structure shown in FIG. 2. A central cavity 54 extends through the thickness of the support structure 40 and permits an actuator pin, such as the actuator pin 20 shown in FIG. 1, to extend from a position above the support structure to a position below the support structure and within the case 10 of the switch structure. An opening 58 extends through the support structure and through cavity 54 to permit a pivot pin to be inserted therethrough. Although only one opening 58 is shown in FIG. 3, it should be understood that two openings are aligned with each other to permit the support of the pivot pin to be achieved.

Figure 4:
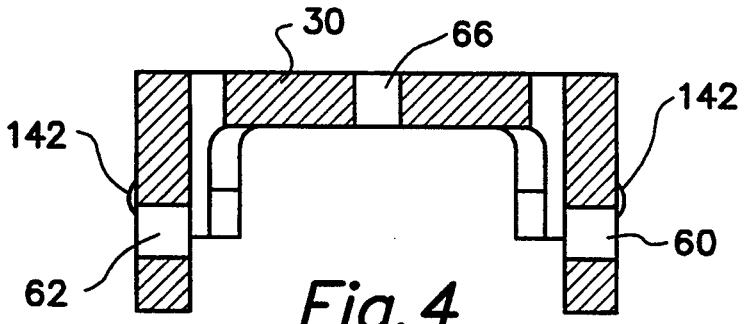
Fig. 4 (PRIOR ART)
FIG. 4 illustrates a button frame known to those skilled in the art.
Figure 5:
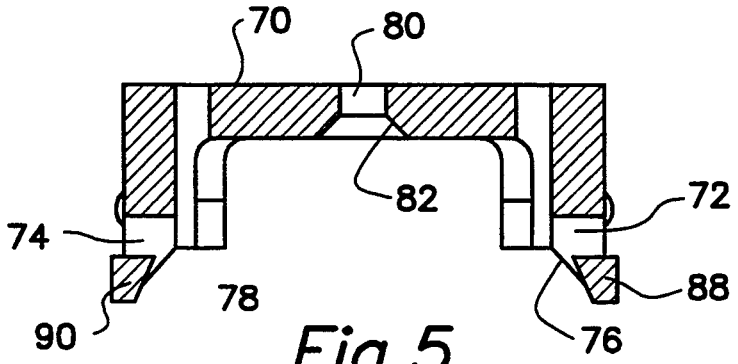
FIG. 5 shows a button frame made in accordance with the present invention.

FIG. 4 shows a button frame 30 which is known to those skilled in the art and which has been used in association with rocker switches for many years. The button frame 30 shown in FIG. 4 comprises two openings, 60 and 62, which are shaped to receive a pivot pin therethrough. In addition, a third opening 66 is provided in the upper portion of the button frame and is shaped to receive an upper end of an actuator pin therein. Openings 60 and 62 permit the button frame to rotate about a central axis of a pivot pin and opening 66 permits this rotation to cause an actuator pin to rotate about the same central axis of the pivot pin. It should be understood that the components shown in FIGS. 1, 2, 3 and 4 are all well known to those skilled in the art and represent the type of rocker switches that are commercially available from numerous sources. FIG. 5 shows a button frame made in accordance with the present invention so that it can be compared, in a side by side illustration, with FIG. 4. Several differences can be seen in the button frame 70 of the present invention. Although the button frame 70 of the present invention also comprises a first opening 72 and a second opening 74, these openings are associated with cam surfaces 76 and 78, respectively. In addition, a third opening 80 in the button frame 70 is provided with a tapered surface 82 which enlarges one end of the third opening 80 for reasons which will be described in greater detail below.

With continued reference to FIG. 5, it can be seen that a first expanded portion 88 and a second expanded portion 90 are provided proximate the first and second openings, respectively, and at one end of each associated cam surface, 76 and 78. The purpose of the expanded portions is to provide additional thickness at the region of the button frame 70 where the shape of the cam surface would otherwise severely reduce the thickness of the button frame and possibly create a region of weakened strength that could otherwise fail during use. The button frame 70 of the present invention will be described in greater detail below.

Figure 6:
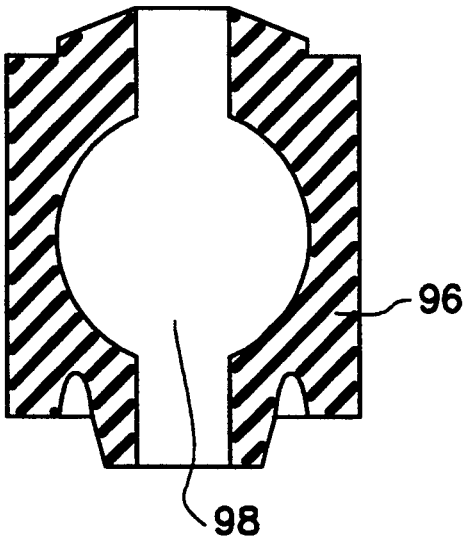
Fig. 6 (PRIOR ART)
FIG. 6 illustrates an elastomeric seal member known in the prior art.

FIG. 6 illustrates an elastomeric seal member 96 which is shaped to be received in the cavity 54 of the support structure 10, as illustrated in FIG. 3. The internal opening 98 of the elastomeric member 96 is shaped to receive a portion of the actuator pin 20 therethrough. By comparing FIGS. 1 and 6, it can be seen that the elastomeric member 96 can serve the purpose of the seal 50. However, the illustration of the seal 50 in FIG. 1 is shaped slightly differently than the elastomeric member 96 shown in FIG. 6. It should be understood that many different styles of elastomeric seals can be used in rocker switches of the type shown in FIG. 1.

Figure 7:
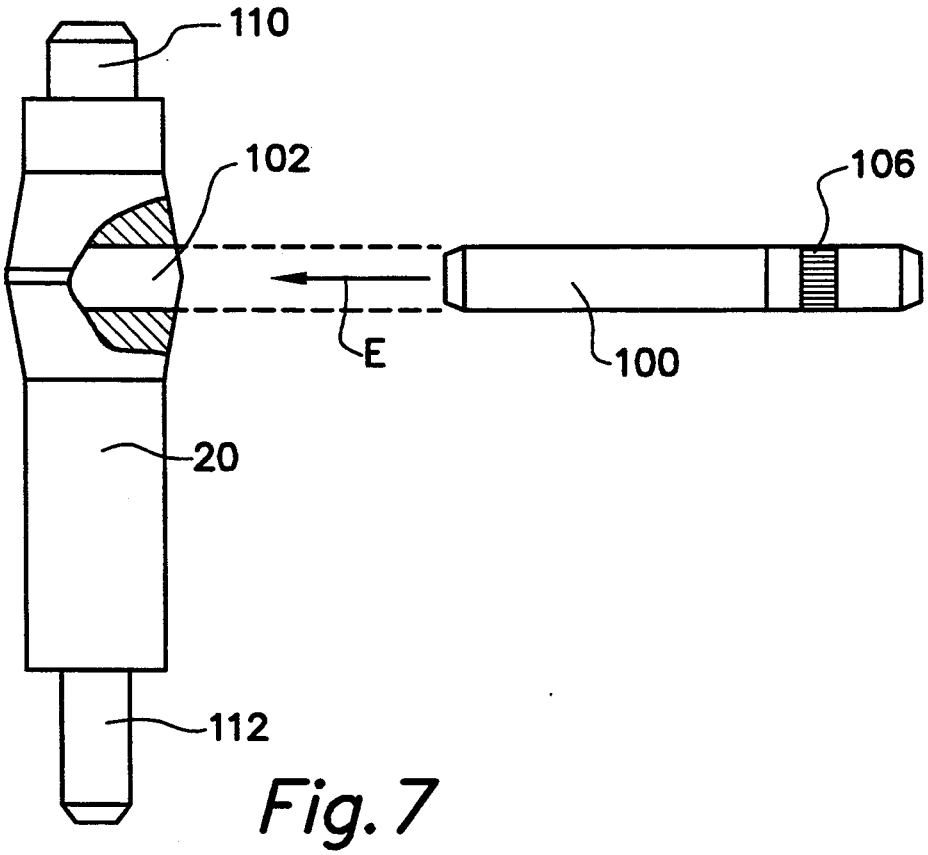
FIG. 7 shows an exploded view of an actuator pin and a pivot pin.
Figure 10:
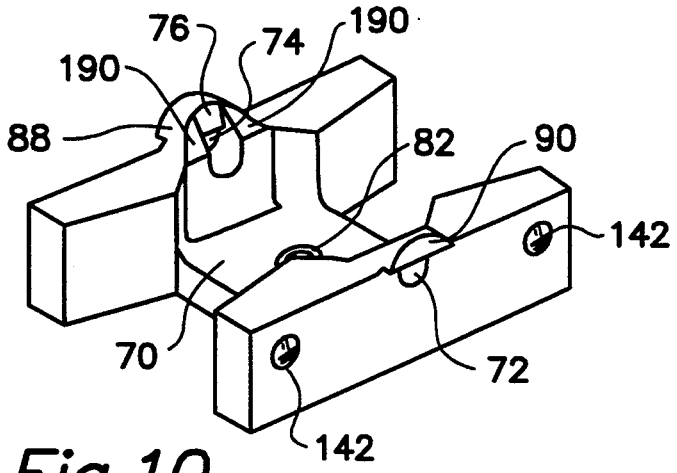
FIGS. 10–12 illustrate various views of the button frame of the present invention.
Figure 11:
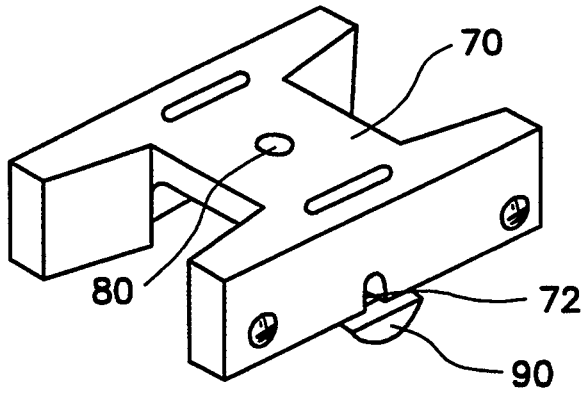
Figure 12:
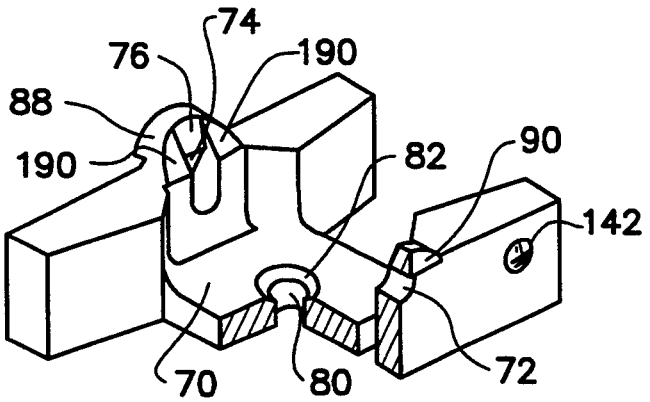

FIG. 7 illustrates an actuator pin 20 such as those which are familiar to the skilled artisan. Associated with the actuator pin 20 is a pivot pin 100 which is shaped to be received in an opening 102 which extends through the actuator pin 20. Although the actuator pin 20 is generally known to those skilled in the art, the pivot pin 100 is slightly different than pivot pins which are familiar to the skilled artisan in the field of switches. The knurled portion 106 is not typically included in known pivot pins, but is provided in pivot pins made in accordance with the present invention because the knurled portion 106 provides a more reliable and permanent attachment between the pivot pin 100 and the support structure of a switch. In switches made according to known techniques, the pivot pin 100 is adequately retained in position by the elastomeric seal, such as those identified by reference numerals 50 and 96 above, whereas the removable nature of the button frame 70, which will be described in greater detail below, necessitates the more reliable means for attaching the pivot pin 100 to the support structure 100.

With continued reference to FIG. 7, a first end 110 of the actuator pin 20 is shaped to be received in the third opening 80 of the button frame 70 described above in conjunction with FIG. 5. A second end 112 of the actuator pin 20 is shaped to be received in attachment with a switching mechanism disposed within the case 10 of a switch made in accordance with the present invention. Arrow E shows the direction in which the pivot pin 100 moves into and through opening 102 of the actuator pin.

Figure 8:
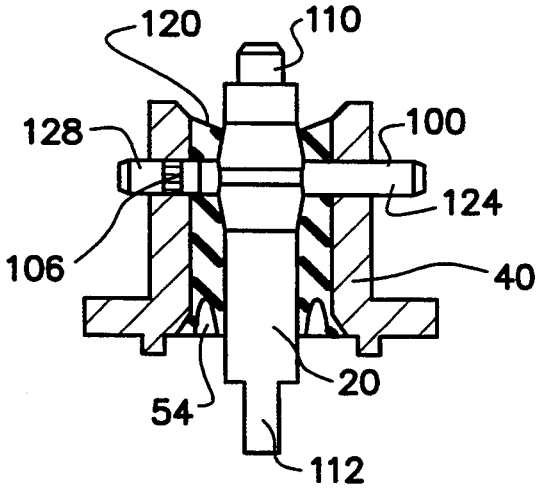
FIG. 8 shows an actuator pin and a pivot pin assembled to each other and associated with a made in accordance with concepts known to those skilled in the art.

FIG. 8 will be used to describe both the known techniques for assembling a rocker switch and the techniques for assembling a switch made in accordance with the present invention. The support structure 40 and its cavity 54 are shown in FIG. 8. The actuator pin 20 extends through two cavity 54 and the pivot pin 100 extends through openings in the support structure 40 and through the opening which extends through the actuator pin 20. As mentioned above, a pivot pin 100 made in accordance with the present invention differs from known pivot pins by the inclusion of the knurled portion 106. Notwithstanding this distinction, FIG. 8 can be used to describe both types of switches, the known switch and the present invention.

If the device shown in FIG. 8 is assembled according to known techniques, the pivot pin 100 would not be inserted through the support structure 40 and the actuator pin 20 until the button frame 30, shown in FIG. 4, was first placed over the upwardly extending portion of the support structure 40. The holes, 60 and 62, of the button frame 30 would first be aligned with the holes extending through the support structure and the actuator pin 20 would be moved upwardly through cavity 54 so that its first end 110 is disposed in opening 66 and its central opening 102 is also aligned with the openings 60 and 62, of the button frame and with the openings which extend through the support structure 40. After this alignment is accomplished, a pivot pin can be inserted through opening 60 of the button frame, one of the openings through the support structure 40, opening 102 of the actuator pin 20, the other opening in the support structure 40 and the other opening 62 in button frame 30. During this insertion process, the pivot pin would pierce the elastomeric seal that had been preplaced in cavity 54 prior to the disposition of the actuator pin 20 therein. Once this assembly process is complete, the button frame 30 can not easily be removed from the support structure 40 without first removing the pivot pin from the support structure. Conversely, the structure could not be adequately assembled by first inserting the pivot pin through the support structure and then attempting to assemble the button frame 30 over the ends of the pin. This restriction can be severely disadvantageous because it would complicate the assembly procedure, as described above, and would severally inhibit the later disassembly of the button frame 30 when the switch is assembled with other equipment.

With continued reference to FIG. 8, the assembly according to the present invention will be described. The actuator pin 20 is extended through cavity 54, to the position shown in FIG. 8. Then, the pivot pin 100, is extended through the holes in the support structure 40 and the opening 102 which extends through the actuator pin 20. This procedure is accomplished without the need for the button frame 70 to be associated with the other components. The procedure described above results in the structure shown in FIG. 8. The knurled portion 106 retains the pivot pin 100 in the support structure 40. As an option to the present invention, the seal 120 can alternatively be disposed within cavity 54 and around the actuator pin 20 and pivot pin 100 after the assembly of the pivot pin to the support structure and actuator pin. This insertion of molten elastomeric material after the assembly shown in FIG. 8 provides a much higher reliability in the seal than the use of preformed seals such as those identified by reference numerals 50 and 96 in FIGS. 1 and 6, respectively. It can be seen that an attempt to dispose a molten elastomeric material in cavity 54 with a button frame attached to pivot pin 100 would be much more difficult than the disposal of this molten elastomer in the cavity without the button frame in position.

With continued reference to FIG. 8, the button frame 70 of the present invention is assembled onto the pivot pin 100 after the structure shown in FIG. 8 is preassembled. A first end 124 of the pivot pin 100 is inserted into the first opening 72 of button frame 70. This is done with the central axis of pivot pin 100 being disposed at an angle of approximately 45 degrees to an axis extending through the first and second openings, 72 and 74, of the button frame 70. Then, the button frame 70 is moved toward an alignment of its first and second openings with the first 124 and second 128 ends of the pivot pin 100. As these components are aligned, the second end 128 of the pivot pin will move into contact with cam surface 78 of the button frame 70. Simultaneously, the first end of 110 of the actuator pin 200 will move into proximity with the tapered surface 82 of the third opening 80. Continued downward pressure exerted against the button frame 70 will cause the second end 128 to move along the cam surface 78 until the second end of the pivot pin 100 moves into the second opening 74 of the button frame. With this alignment of the first and second openings with the first and second ends of the pivot pin, the second end 128 of the pivot pin will snap into position and extend through the second opening 74. Thus, the button frame 70 of the present invention can be assembled onto the pivot pin after the pivot pin is attached to both the actuator pin 20 and the support structure 40.

Figure 9:
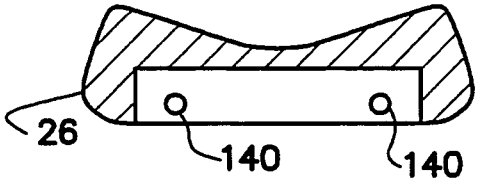
Fig. 9 (PRIOR ART)
FIG. 9 is a button known to those skilled in the art.

FIG. 9 illustrates a button 26 which is generally known to those skilled in the art. The sectional view of the button 26 is provided in FIG. 9 to illustrate the depressions 140 which are formed through side walls of the button 26. In a manner which is generally known to those skilled in the art, the depressions 140 are holes which are shaped to receive protrusions 142 which are formed into the outer surfaces of the button frames, 30 or 70.

FIGS. 10, 11, 12 and 13 show different perspective illustrations of the button frame 70 made in accordance with the present invention in order to show its various features. The first and second openings, 72 and 74, are shown associated with their respective cam surfaces, 76 and 78, and their respective expanded portions, 88 and 90. In addition, the third opening 80 is shown with its tapered surface 82. The preselected distance between the cam surfaces, 76 and 78, is selected to permit the pivot pin 100 to have its first end 124 inserted into the first opening 72 while the button frame 70 is disposed with its first and second openings along an axis which is at an angle approximately 45 degrees to a central axis of the pivot pin 100. In this position, the button frame can be moved toward alignment with the pivot pin. This movement causes the second end 128 of the pivot pin to move into contact with the second cam surface 78 and, after sliding in contact with the cam surface, move into the second opening 74. This occurs with a snap as the pivot pin distorts the button frame 70 sufficiently for it to move into clearance association with the first and second openings of the button frame.

With continued reference to FIGS. 10, 11, 12 and 13, surfaces 190 also provide a useful feature of the present invention. As the button frame 70 is moved into alignment with the pivot pin 100, the portions of the button frame on both sides of the first and second openings and on both sides of the first and second cam surfaces could possibly interfere with portions of the support structure. These edges that could possibly interfere during the assembly process are removed. This results in the beveled surfaces 190 shown in FIGS. 10, 12 and 13.

Figure 13:
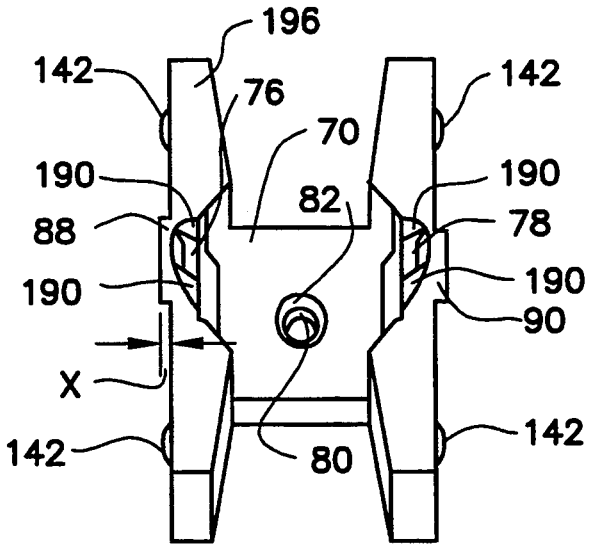
FIG. 13 illustrates perspective views of a button frame made in accordance with the present invention.

With reference to FIG. 13, dimension X illustrates the expanded portion of the button frame 70 which is provided to strengthen the region where the cam surfaces and the bevels result in the removal of a portion of the wall structure of the button frame. As can be seen, if dimension X were reduced to zero and the expanded portion 88 was not provided, the wall where surface 196 intersects with the surfaces of bevels 190 would be extremely thin and could possibly be damaged.

With reference to FIGS. 10, 11, 12 and 13, it can be seen that the first and second openings, 72 and 74 are not perfectly circular in shape. Instead, they are slightly D-shaped. This shape was chosen for a specific purpose. As the second end of the pivot pin moves along the second cam surface, it eventually snaps into the second opening. During the final portion of the sliding contact between the second end 128 of pivot pin 100 and the second cam surface 78, the pointed edge where the cam surface intersects with the inner surface of the second opening can become slightly distorted and the plastic material of the button frame can be pushed inward toward the center of the second opening. If the second opening was perfectly circular, this distortion could possibly reduce the clearance between the outer surface of the pivot pin 100 and the inner surface of the second opening 74. To avoid this, the first and second openings are slightly enlarged in one direction to result in the D-shape. The D-shaped openings, 72 and 74, also facilitate the insertion of the pivot pin by allowing the first end of the pivot pin to be in the first opening 72 even though the central axis of the pivot pin is not aligned with an axis that extends through both the first and second openings, 72 and 74.

A switch made in accordance with the present invention is provided with a button frame that is easily removed from attachment to a pivot pin which extends through a support structure of the switch. The button frame is provided with first and second openings that are associated with first and second cam surfaces formed in a surface of the button frame. The preselected dimension between the cam surfaces is chosen to permit a first end of the pivot pin to be inserted into a first opening of the button frame with the button frame at an angle of approximately 45 degrees to a central axis of the pivot pin. As the button frame is moved into alignment with the pivot pin, a second end of the pivot pin slides along a second cam surface and eventually snaps into the second opening of the button frame. The button frame is also provided with slots which permit an external tool, such as a screwdriver, to be used to temporarily distort the button frame and permit its removal from the pivot pin. The distortion of the button frame temporarily increases the preselected distance between the first and second cam surfaces and permits the removal of the second end of the pivot pin from the second opening of the button frame.

Figure 14:
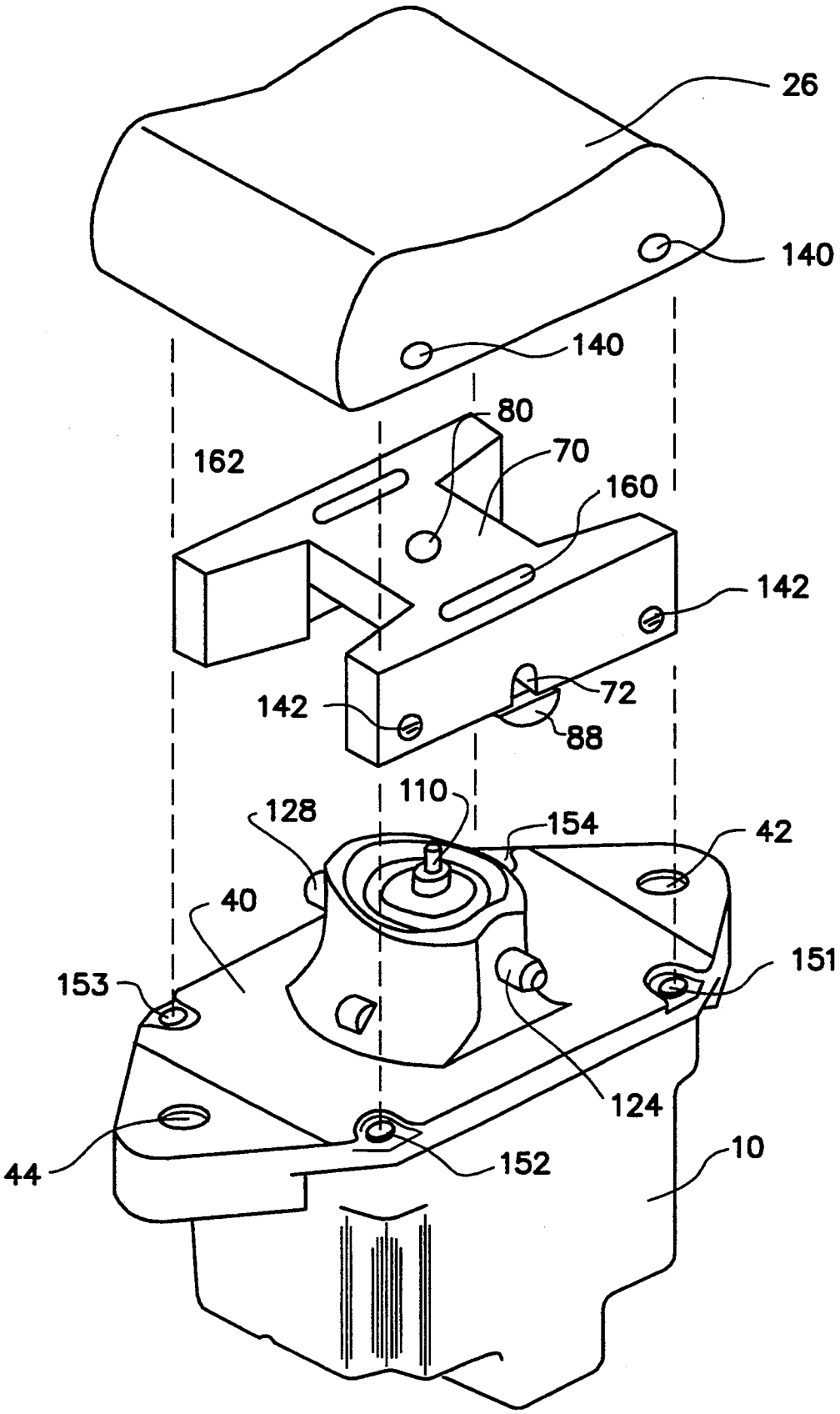
FIG. 14 shows an exploded view of the present invention.
Figure 15:
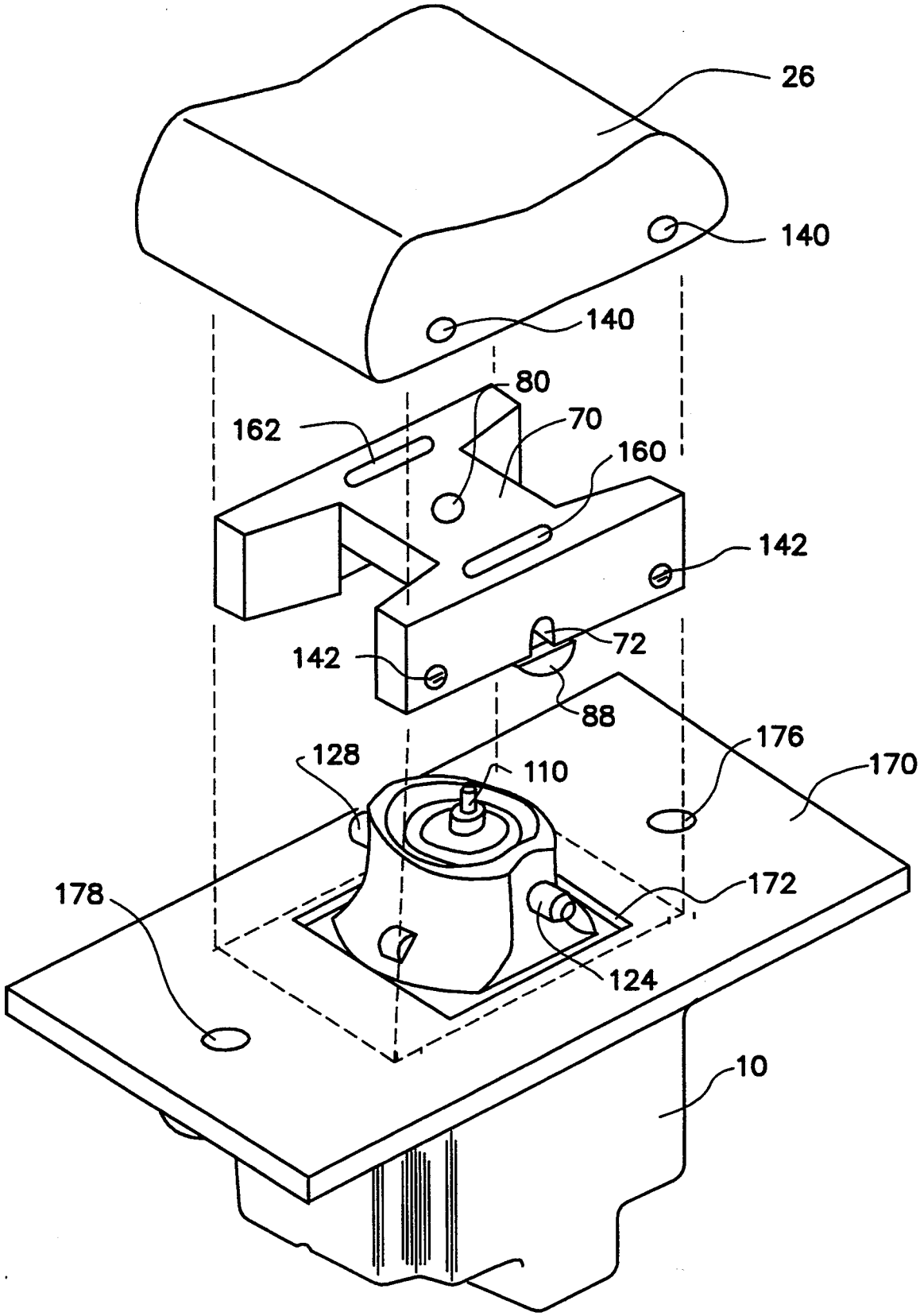
FIG. 15 shows an exploded view of the present invention associated with a mounting panel.

FIG. 14 shows an exploded view of a support structure 40, a button frame 70 and a button 26. The purpose of FIG. 14 is to show the relative positions and sizes of the components so that a particular advantageous attribute of the present invention can be described below in conjunction with FIG. 15. FIGS. 14 and 15 will permit a comparison that illustrates this advantage. With reference to FIG. 14, it can be seen that the support structure 40 is attached to the case 10 by four rivets, 151, 152, 153 and 154. When the button frame 70 is attached to the first and second ends of the pivot pin 100, the outer corners of the button frame 70 will be located relative to the upper surface of the support structure 40 as indicated by the vertical dashed lines in FIG. 14. The button 26, which is slightly larger than the button frame 70, will extend over a slightly greater area than that which is represented by the four vertical dashed lines in FIG. 14. Because of the concepts of the present invention, the button frame 70 can be removed from its attachment with the pivot pin 100. To facilitate this removal, two slots, 160 and 162, are provided in the button frame 70 in a manner generally known to those skilled in the art. With the button frame 70 attached in rotatable association with the pivot pin 100, a blade can be inserted into slot 160. For example, a screwdriver blade will suffice for these purchases. With the blade inserted into slot 160, the screwdriver can be used to slightly distort the button frame 70 in a direction so that the predetermined distance between the cam surfaces is increased. This increase will permit the first end 124 of the pivot pin to be removed from its associated first opening 72 in the button frame. The button frame can then be easily removed from association with the second end 128 of the pivot pin. As should also be understood, the button 26 would first be removed from button frame 70 by exerting an upward force to move the button 26 away from the support structure. This will cause the button to distort slightly so that the protrusions 142 will move out of the depressions 140.

FIG. 15 shows the arrangement of FIG. 14 with the additional illustration of a mounting panel 170. An opening 172 is formed through the mounting panel 170 and a portion of the support structure 40 is inserted through the opening 172. The mounting holes, 42 and 44, provide a means for attaching the upper surface of the support structure 40 shown in FIG. 14 to the lower surface of the mounting panel 170 shown in FIG. 15. The threaded holes, 176 and 178 facilitate this attachment.

In FIG. 15, it can be seen that the area of the button frame 70 is larger than the area of opening 172. Therefore, the total assembled switch could not normally be connected to the mounting panel 170 with switches made in accordance with known techniques because the button frame 70 can not pass through opening 172. By permitting the easy removal of button frame 70 from support structure 40, the present invention allows the rocker switch to be assembled in association with a mounting panel 170 or other structure of this type. As an example of this advantage, it can be seen that a completely assembled switch can be associated with a large structure, such as a dashboard of a vehicle, by disassembling the button frame 70 from the support structure 40, inserting a portion of the support structure through an opening in the large structure, as represented by the illustration in FIG. 5, and then reassembling the button frame 70 to the pivot pin described above.

Although the present invention has been described with significant detail and illustrated with specificity, it should be understood that alternative embodiments of the present invention are also within its scope.

The embodiments of the invention in which an exclusive property or right is claimed are defined as follows:

1. A switch, comprising:

an actuator pin;

a pivot pin extending perpendicularly through said actuator pin;

a support structure, said pivot in being supported by said support structure, said actuator pin being rotatable about a central axis of said pivot pin, said pivot pin having first and second ends which extend away from said actuator pin and from said support structure; and a button frame having a first opening surrounded by a wall portion and a second opening surrounded by a wall portion formed therein and shaped to receive said first and second ends of said pivot pin, said button frame having a third opening formed to receive a first end of said actuator pin therein, said button frame having first and second cam surfaces formed in said respective wall portions and extending, respectively from said first and second openings to edges of said button frame, said first and second cam surfaces being spaced apart by a preselected distance to permit said second end of said pivot pin to slide on said cam surface and into said second opening when said first end of said pivot pin is disposed within said first opening of said button frame.

2. The switch of claim 1, further comprising:
a button attached to said button frame.

3. The switch of claim 2, wherein:
said button frame comprises a plurality of protrusions on its outer surface; and
said button comprises a plurality of depressions, each of said depressions being shaped to receive a preselected one of said protrusions in snap action containment therein.

4. The switch of claim 1, further comprising:
a first expanded portion of said button frame proximate said first cam surface and a second expanded portion of said button frame proximate said second cam surface.

5. The switch of claim 1, further comprising:
a tapered portion of said third opening of said button frame to define one enlarged end of said third opening to permit entry of said first end of said actuator in into said third opening when said first end of said pivot pin is disposed within said first opening of said button frame and said second end of said pivot pin is in contact with said second cam surface.

6. The switch of claim 1, wherein:
said switch is a rocker switch.

7. The switch of claim 1, further comprising:
a first slot formed in said button frame and shaped to receive a blade therein for distorting said button frame to increase said preselected distance.

8. The switch of claim 1, further comprising:
a case attached to said support structure.

9. The switch of claim 8, further comprising:
an electrical switching mechanism disposed within said case and connected to a second end of said actuator pin.

10. The switch of claim 1, further comprising:
a mounting panel attached to said support structure, said mounting panel having first and second planar surfaces, said support structure extending through an opening formed through said mounting panel.

11. A switch, comprising:
an actuator pin;
a pivot pin extending perpendicularly through said actuator pin;
a support structure, said pivot pin being supported by said support structure, said actuator pin being rotatable about a central axis of said pivot pin, said pivot pin having first and second ends which extend away from said actuator pin and from said support structure; and
a button frame having a first opening surrounded by a wall portion and a second opening surrounded by a wall portion formed therein and shaped to receive said first and second ends of said pivot pin, said button frame having a third opening formed to receive a first end of said actuator pin therein, said button frame having first and second cam surfaces formed in said respective wall portions and extending, respectively, from said first and second openings to edges of said button frame, said first and second cam surfaces being spaced apart by a preselected distance to permit said second end of said pivot pin to slide on said cam surface and into said second opening when said first end of said pivot pin is disposed within said first opening of said button frame, said third opening comprising a tapered portion shaped to define one enlarged end of said third opening to permit entry of said first end of said actuator pin into said third opening when said first end of said pivot pin is disposed within said first opening of said button frame and said second end of said pivot pin is in contact with said second cam surface.

12. The switch of claim 11, further comprising:
a button attached to said button frame.

13. The switch of claim 12, wherein:
said button frame comprises a plurality of protrusions on its outer surface; and
said button comprises a plurality of depressions, each of said depressions being shaped to receive a preselected one of said protrusions in snap action containment therein.

14. The switch of claim 11, further comprising:
a first expanded portion of said button frame proximate said first cam surface and a second expanded portion of said button frame proximate said second cam surface.

15. The switch of claim 11, further comprising:
a first slot formed in said button frame and shaped to receive a blade therein for distorting said button frame to increase said preselected distance.

16. The switch of claim 11, further comprising:
a case attached to said support structure.

17. The switch of claim 16, further comprising:
an electrical switching mechanism disposed within said case and connected to a second end of said actuator pin.

18. The switch of claim 11, further comprising:
a mounting panel attached to said support structure, said mounting panel having first and second planar surfaces, said support structure extending through an opening formed through said mounting panel.

19. A switch, comprising:
an actuator pin;
a pivot pin extending perpendicularly through said actuator pin;
a support structure, said pivot pin being supported by said support structure, said actuator pin being rotatable about a central axis of said pivot pin, said pivot pin having first and second ends which extend away from said actuator pin and from said support structure;
a button frame having a first opening surrounded by a wall portion and a second opening surrounded by a wall portion formed therein and shaped to receive said first and second ends of said pivot pin, said button frame having a third opening formed to receive a first end of said actuator pin therein, said button frame having first and second cam surfaces formed in said respective wall portions and extending, respectively from said first and second openings to edges of said button frame, said first and second cam surfaces being spaced apart by a preselected distance to permit said second end of said pivot pin to slide on said cam surface and into said second opening when said first end of said pivot pin is disposed within said first opening of said button frame, said third opening comprising a tapered portion shaped to define one enlarged end of said third opening to permit entry of said first end of said actuator pin into disposed within said first opening of said button frame and said second end of said pivot pin is in contact with said second cam surface;

a first expanded portion of said button frame proximate said first cam surface and a second expanded portion of said button frame proximate said second cam surface;

a button attached to said button frame, said button frame comprising a plurality of protrusions on its outer surface, said button comprising a plurality of depressions, each of said depressions being shaped to receive a preselected one of said protrusions in snap action containment therein;

a first slot formed in said button frame and shaped to receive a blade therein for distorting said button frame to increase said preselected distance;

a case attached to said support structure; and an electrical switching mechanism disposed within said case and connected to a second end of said actuator pin.

20. The switch of claim 19, further comprising:

a mounting panel attached to said support structure, said mounting panel having first and second planar surfaces, said support structure extending through an opening formed through said mounting panel.

* * * * *